US010236633B2

(12) United States Patent
Listing et al.

(10) Patent No.: US 10,236,633 B2
(45) Date of Patent: Mar. 19, 2019

(54) ELECTRIC PLUG CONNECTOR WITH VIBRATION-RESISTANT SHORT-CIRCUITING BRIDGE AND ELECTRIC PLUG CONNECTION

(71) Applicant: TE Connectivity Germany GmbH, Bensheim (DE)

(72) Inventors: Martin Listing, Langen (DE); Stefan Siegert, Bensheim (DE); Wolfgang Balles, Mannheim (DE); Joachim Toboldt, Furth (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/879,774

(22) Filed: Jan. 25, 2018

(65) Prior Publication Data

US 2018/0151984 A1 May 31, 2018

Related U.S. Application Data

(63) Continuation of application No. PCT/EP2016/068023, filed on Jul. 28, 2016.

(30) Foreign Application Priority Data

Jul. 28, 2015 (DE) ..... 10 2015 214 284

(51) Int. Cl.
*H01R 13/641* (2006.01)
*H01R 13/707* (2006.01)
(Continued)

(52) U.S. Cl.
CPC ..... *H01R 13/641* (2013.01); *H01R 13/6271* (2013.01); *H01R 13/707* (2013.01);
(Continued)

(58) Field of Classification Search
CPC ..... H01R 13/641; H01R 13/6271; H01R 4/66
(Continued)

(56) References Cited

U.S. PATENT DOCUMENTS 5,391,087 A * 2/1995 Fukuda ..... H01R 13/641 439/188
5,464,353 A * 11/1995 Saijo ..... H01R 13/4362 439/188
(Continued)

FOREIGN PATENT DOCUMENTS

JP 0412275 U 1/1992
JP 2001110511 A 4/2001
(Continued)

OTHER PUBLICATIONS

PCT Notification, International Search Report and Written Opinion, dated Oct. 14, 2016, 14 pages.
Abstract of JP2001110511, dated Apr. 20, 2001, 1 page.

*Primary Examiner* — Tulsidas C Patel
*Assistant Examiner* — Peter G Leigh
(74) *Attorney, Agent, or Firm* — Barley Snyder

(57) ABSTRACT

A plug connector for connection with a mating connector in a plugging direction comprises a plug housing having a receptacle and a short circuiting bridge held in a plugging position in the receptacle. The short circuiting bridge has a pair of short circuiting contacts accessible from outside the plug connector counter to the plugging direction. The short circuiting bridge is movable about the plugging position within the receptacle.

14 Claims, 7 Drawing Sheets

(51) Int. Cl.

| | |
|---|---|
| ***H01R 31/08*** | (2006.01) |
| ***H01R 13/627*** | (2006.01) |
| *H01R 103/00* | (2006.01) |
| *H01R 13/631* | (2006.01) |
| *H01R 13/645* | (2006.01) |

(52) U.S. Cl.
CPC ..... *H01R 31/08* (2013.01); *H01R 13/6315* (2013.01); *H01R 13/645* (2013.01); *H01R 2103/00* (2013.01); *H01R 2201/26* (2013.01)

(58) Field of Classification Search
USPC ..... 439/510
See application file for complete search history.

(56) References Cited

U.S. PATENT DOCUMENTS 5,588,872 A * 12/1996 Fukuda ..... H01R 13/641 439/188
5,613,872 A * 3/1997 Fukuda ..... H01R 13/641 439/188
6,422,894 B1 * 7/2002 Endo ..... H01R 13/641 439/188
7,470,156 B2 * 12/2008 Suemitsu ..... H01R 13/4362 439/752
7,833,061 B2 * 11/2010 Hori ..... H01R 13/7195 439/620.21
8,052,489 B2 * 11/2011 Mase ..... H01R 13/4223 439/595
8,550,853 B2 * 10/2013 Fukushi ..... H01R 4/4836 439/441
8,721,375 B2 * 5/2014 Hori ..... H01R 13/4362 439/752
9,083,114 B2 * 7/2015 Muro ..... H01R 13/627
2008/0124966 A1 * 5/2008 Lim ..... H01R 13/6272 439/357
2010/0255709 A1 * 10/2010 Tyler ..... H01R 13/53 439/367
2012/0328359 A1 * 12/2012 Hori ..... H01R 13/4362 403/218
2015/0017823 A1 * 1/2015 Hori ..... H01R 31/08 439/101

FOREIGN PATENT DOCUMENTS

| | | |
|---|---|---|
| WO | 2011015532 A1 | 2/2011 |
| WO | 2013093546 A1 | 6/2013 |
| WO | 2013109747 A1 | 7/2013 |

* cited by examiner

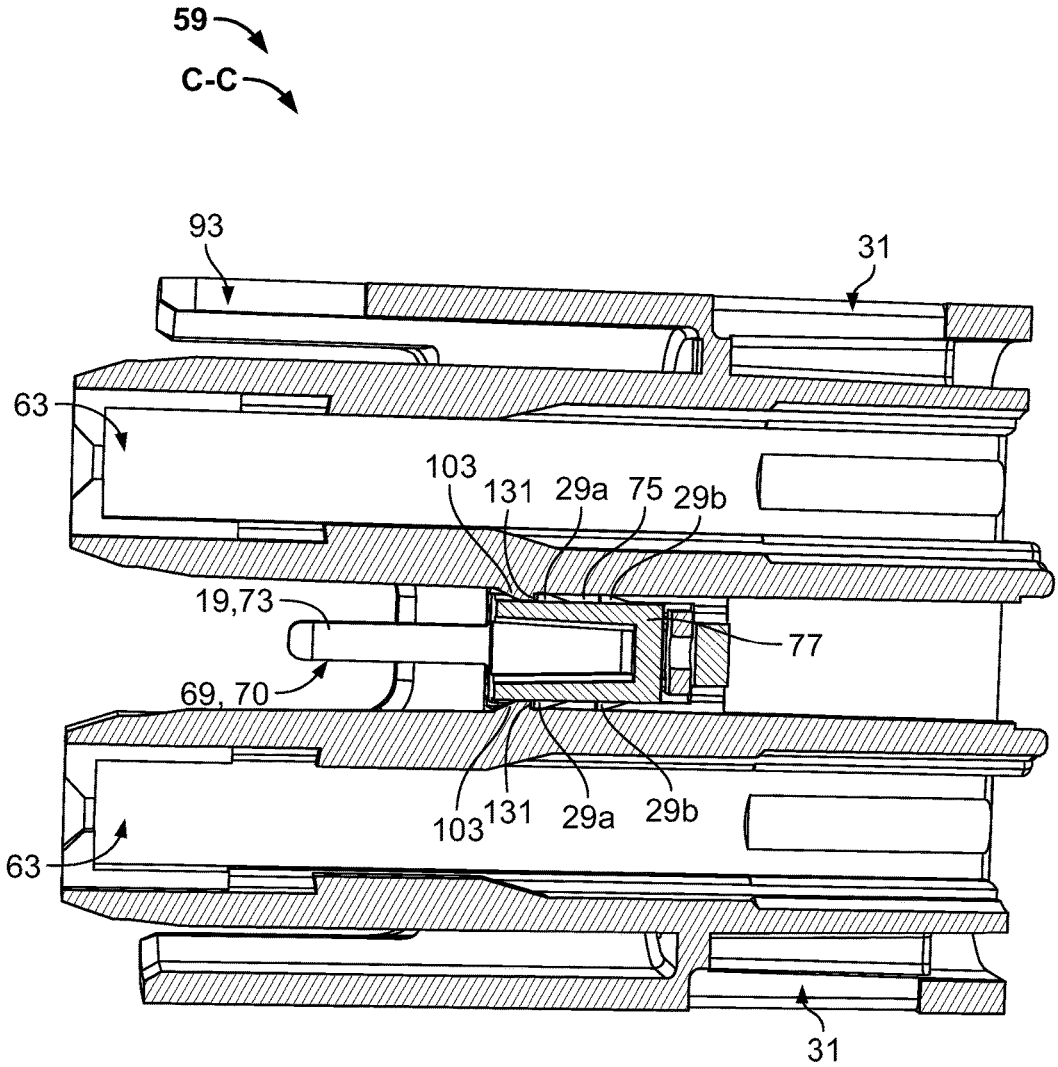
Fig. 9
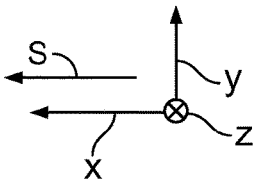

ELECTRIC PLUG CONNECTOR WITH VIBRATION-RESISTANT SHORT-CIRCUITING BRIDGE AND ELECTRIC PLUG CONNECTION

CROSS-REFERENCE TO RELATED APPLICATIONS

This application is a continuation of PCT International Application No. PCT/EP2016/068023, filed on Jul. 28, 2016, which claims priority under 35 U.S.C. § 119 to German Patent Application No. 102015214284.1, filed on Jul. 28, 2015.

FIELD OF THE INVENTION

The present invention relates to a plug connector and, more particularly, to a plug connector having a short circuiting bridge.

BACKGROUND

Plug connectors which have a short circuiting bridge in order to signal the plugging together of the plug connector with a mating connector are known in the art. Such known plug connectors are of two types: there are plug connectors with short circuiting bridges which are attached in a fixed and secure fashion in the plug connector and there are plug connectors with short circuiting bridges which are flexible and extend out of the plug connector.

A flexible short-circuiting bridge is used to detect plugging together with the mating connector by moving the short-circuiting bridge away from an electrical contact of the plug connector during plugging, thereby interrupting a generated short circuit during plugging. Alternatively, for a short circuiting bridge disposed in each of the plug connector and the mating connector, the short circuiting bridge generates the short circuit after the plug connector is plugged together with the mating connector. In known short circuiting bridges having flexible contact arms which move away from the electrical contact, a defect of the contact arm or clamping of the contact arm can cause the short circuiting bridge to interrupt the short circuit and incorrectly indicate a correct plugging together of the plug connector and the mating connector. The alternative generation of a short circuit during the plugging together overcomes this potential issue.

For a short circuiting bridge disposed in each of the plug connector and the mating connector, the short circuiting bridge is movably arranged in the plug connector. The short circuiting bridge moves within the plug connector over a distance which is larger than the plug in depth of a short circuiting contact into a complementary short circuiting receptacle of the short circuiting bridge. In certain fields of technology, such as during use in motor vehicles or in forming electrical connections in compressors, a plug connection between the plug connector and the mating connector can be subject to strong vibrations. The short circuiting bridge must be able to signal a correctly plugged together state of the plug connector and the mating connector even if the plug connection is subject to strong vibrations.

Generally, when there is heavy vibration loading, a significant relative movement occurs between the contact faces of the known short circuiting bridge and the complementary short circuiting contacts. Movement of the plug connector relative to the mating connector can lead, given a corresponding vibration loading, to contacts of the short circuiting bridge being abraded away or fractured, impairing detection of the correctly plugged together state.

SUMMARY

A plug connector for connection with a mating connector in a plugging direction comprises a plug housing having a receptacle and a short circuiting bridge held in a plugging position in the receptacle. The short circuiting bridge has a pair of short circuiting contacts accessible from outside the plug connector counter to the plugging direction. The short circuiting bridge is movable about the plugging position within the receptacle.

BRIEF DESCRIPTION OF THE DRAWINGS

The invention will now be described by way of example with reference to the accompanying Figures, of which:

FIG. 9 is a sectional view of the contact housing taken along line C-C of FIG. 4.

DETAILED DESCRIPTION OF THE EMBODIMENT(S)

Figure 1:
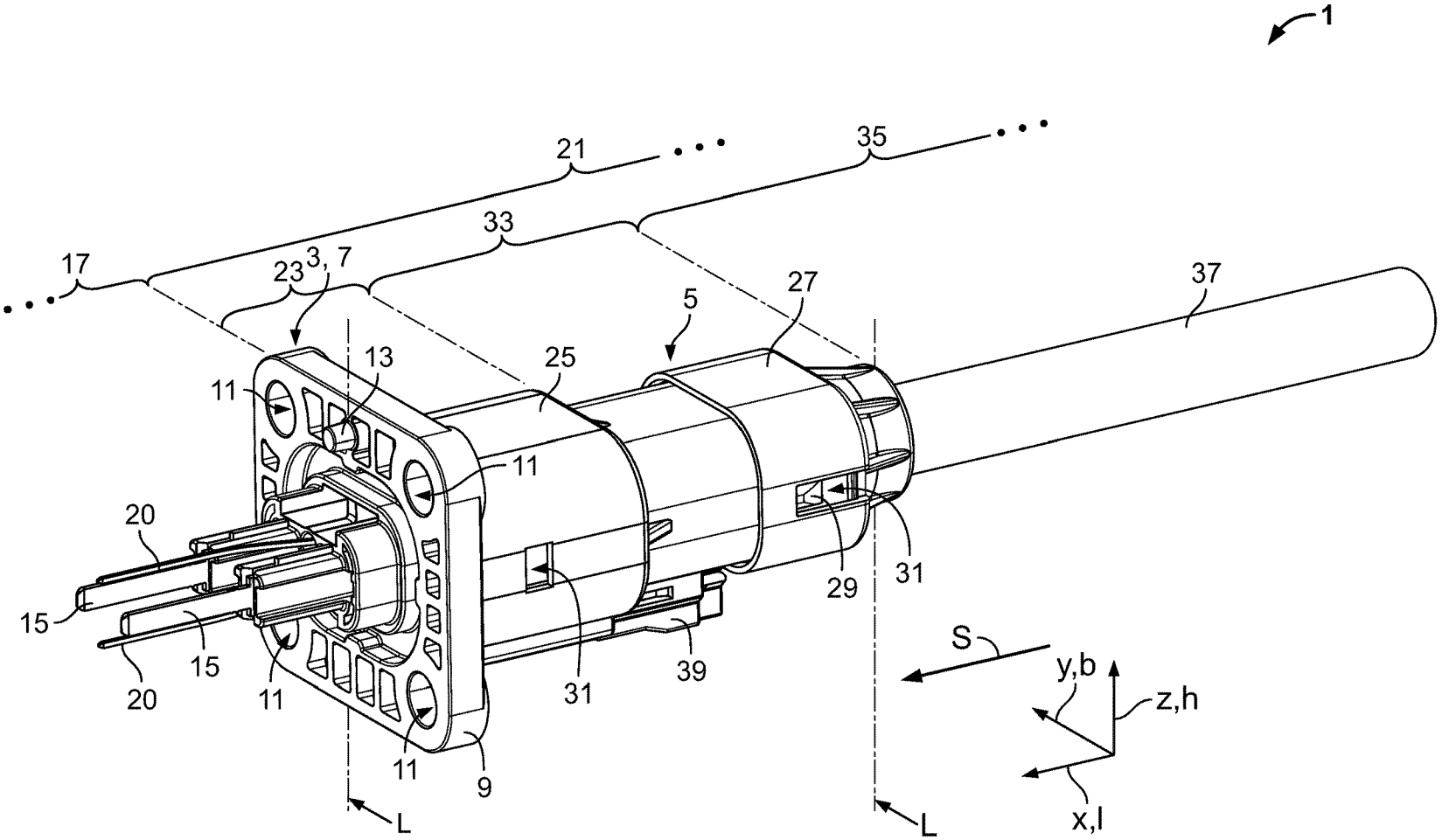
FIG. 1 is a perspective view of an electric plug connection according to the invention.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Figure 2:
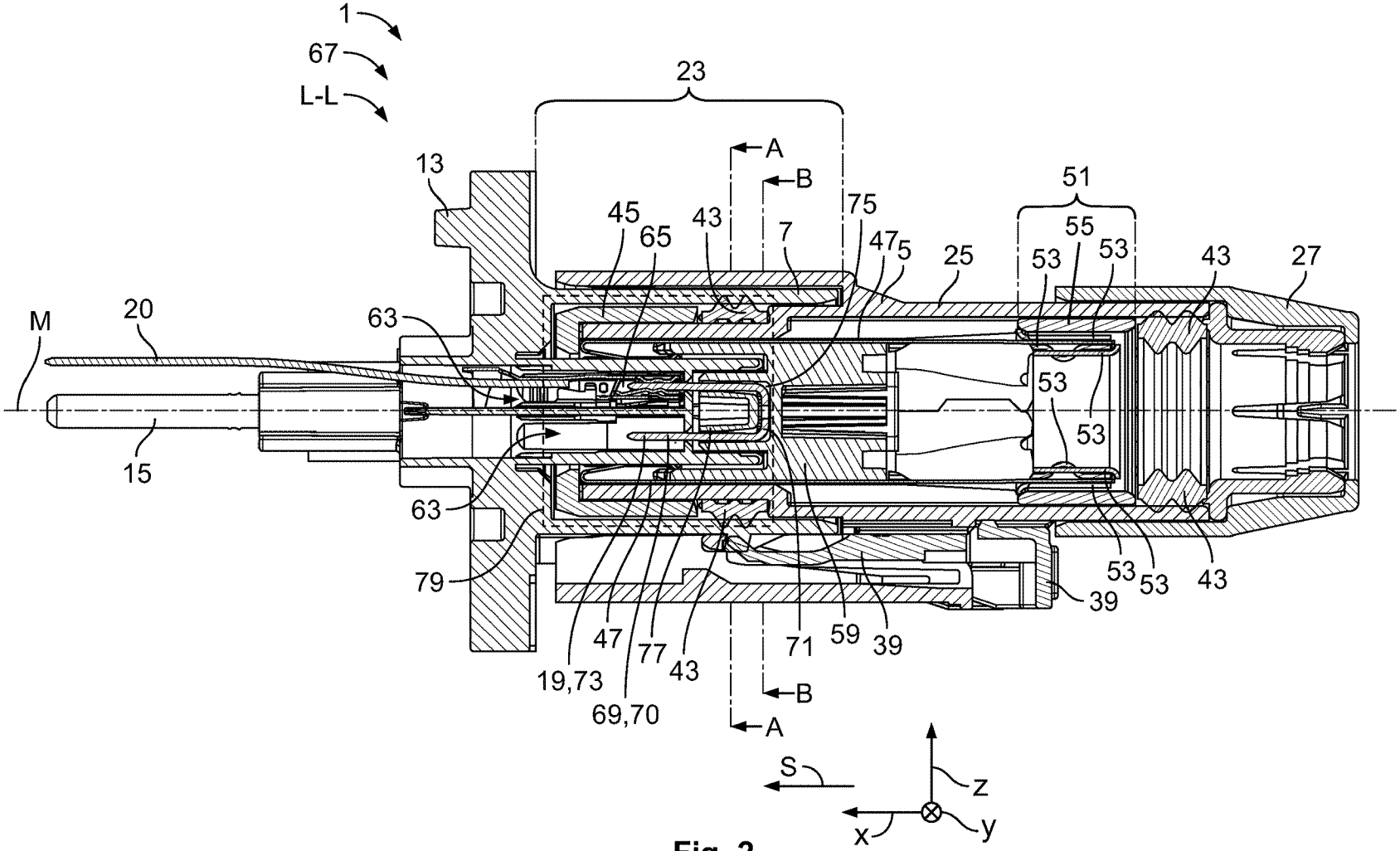
FIG. 2 is a sectional view of the electric plug connection taken along line L-L of FIG. 1.
Figure 3:
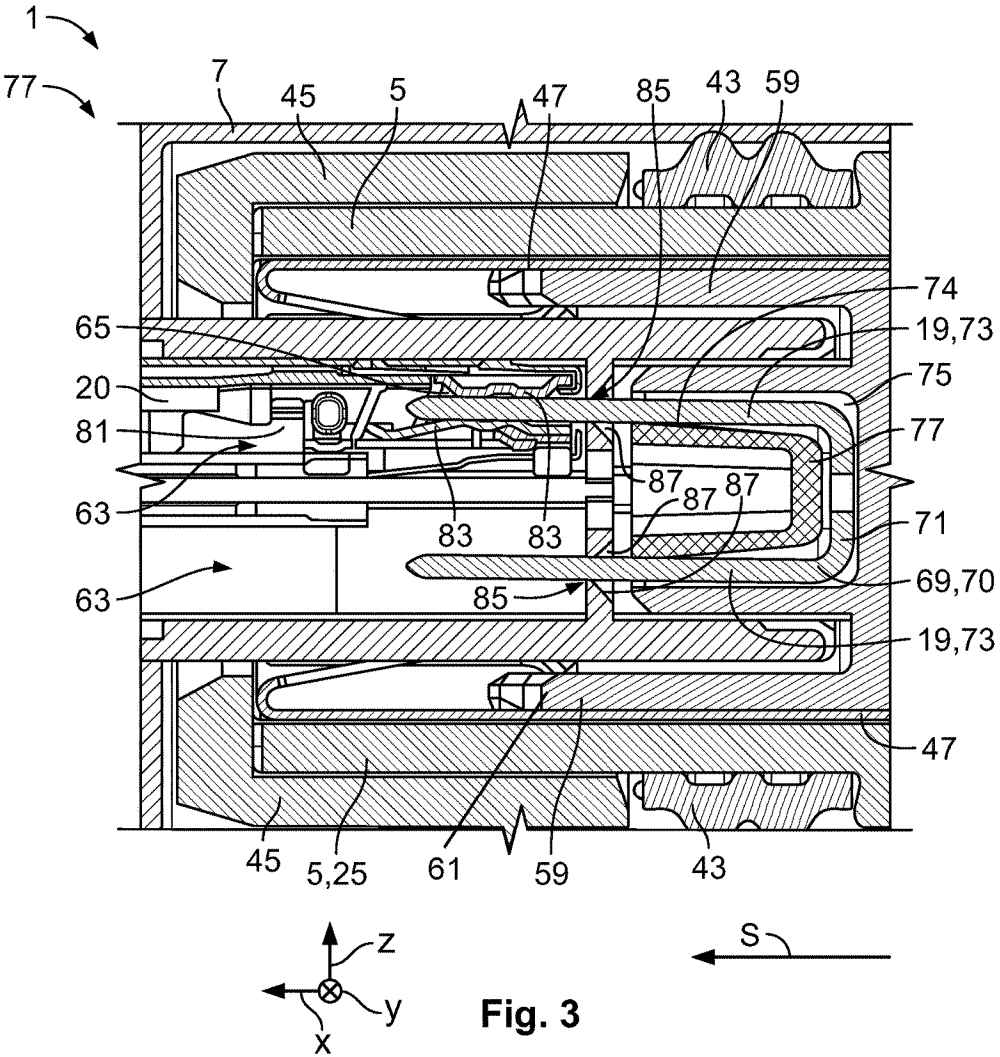
FIG. 3 is a detail view of FIG. 2.

An electric plug connection 1 according to the invention is shown in FIGS. 1-3. The electric plug connection 1 comprises a plug connector 5 and an assembly connection 3 embodied as a mating connector 7. The electric plug connection 1 has a width b which is measured along a y axis, and a length 1 which is measured along an x axis, wherein the x axis is parallel to a plugging direction S as shown in FIG. 1. The electric plug connection 1 has a height h which is measured along a z axis.

The mating connector 7, as shown in FIG. 1, has a flange 9 which surrounds a plurality of attachment openings 11. The attachment openings 11 are disposed in a plurality of corners of the flange 9; the corners are rounded. The mating connector 7 can be attached to an assembly (not shown) with attachment elements, such as screws, bolts, or pins, extending through the attachment openings 11.

The mating connector 7, as shown in FIGS. 1 and 2, has a positioning element 13 extending in the plugging direction S. The positioning element 13 can be inserted, for example, into a complementary positioning receptacle (not shown) to ensure that the flange 9 and therefore the entire mating connector 7 can be attached with a correct positioning to the assembly (not shown), which ensures that a polarity of each of a plurality of loading contacts 15 is not interchanged.

In addition to the loading contacts 15, as shown in FIG. 1, the mating connector 7 has a plurality of mating short circuiting contacts 20 on an assembly side 17 of the mating connector 7 and extending in the plugging direction S. The loading contacts 15 are arranged one next to the other along the y axis, while the mating short circuiting contacts 20 are arranged one above the other along the z axis. On a plug side 21 extending from the flange 9 counter to the plugging direction S, the mating connector 7 has a receptacle region 23 as shown in FIGS. 1 and 2.

A first plug housing 25 of the plug connector 5 is also located in the receptacle region 23, as shown in FIG. 1. The first plug housing 25 extends from the flange 9 counter to the plugging direction S as far as a strain relief housing 27, wherein the first plug housing 25 is partially accommodated in the strain relief housing 27. A latching hook 29 of the first plug housing 25 latches in a latching opening 31 of the strain relief housing 27. The first plug housing 25 has additional latching openings 31 which extend in and counter to the y direction, extending laterally though the first plug housing 25.

As shown in FIG. 1, the receptacle region 23 is adjoined, counter to the plugging direction S, by a plug region 33 which extends between the receptacle region 23 and a cable region 35. The loading lines (not shown) within a stranded conductor 37 extend in plugging direction S from the cable region 35 to and into the plug connector 5.

A second contact securing device 39 shown in FIGS. 1 and 2 secures the connection between the plug connector 5 and the electric mating connector 7.

As shown in FIG. 2, the plug connector 5 overlaps with the mating connector 7 over almost the entire receptacle region 23. A plurality of sealing elements 43 disposed in the z y plane are arranged between the plug connector 5 and the electric mating connector 7 or between the plug connector 5 and the stranded conductor 37.

A retaining element 45 in the plug connector 5, as shown in FIG. 2, retains both the sealing elements 43 and a plurality of screening plates 47 in the plugging direction S to prevent them from dropping out of the plug connector 5. The retaining element 45 has a latching hook which latches into a latching opening of the first plug housing 25 and secures the retaining element 45 to prevent a relative movement in the plugging direction S away from the plug connector 5. The screening plates 47 extend from a retaining contour 49 of the retaining element 45 into a crimp region 51. A contact housing 59 shown in FIG. 2, which has a plug face 61 shown in FIG. 3 pointing in the plugging direction S, is located partially within the screening plates 47.

The crimp region 51, as shown in FIG. 2, has a plurality of overlapping sleeves 53 and a spacer element 55. The loading lines enclosed by the stranded conductor 37 and guided through the strain relief housing 27 in the plugging direction S are secured by the sleeves 53. The spacer element 55 spaces the sleeves 53 apart from the first plug housing 25.

The mating connector 7 has two socket receptacles 63 as shown in FIG. 2. In the socket receptacle 63 located in the z direction from the center axis M, a short-circuiting socket 65 is shown which is electrically connected to the short circuiting contact 19.

The electric plug connection 1 is shown in the plugging position 67 in FIG. 2. In the plugging position 67, a short circuiting bridge 69 projects into the socket receptacles 63 of the electric mating connector 7. The short circuiting bridge 69 is located in a plugging position 70 in FIG. 2. The short circuiting bridge 69 has a U shaped profile, wherein a bottom 71 of the short circuiting bridge 69 and parts of the limbs 73 of the short circuiting bridge 69 are accommodated in a receptacle 75. In an embodiment, the short circuiting bridge 69 is formed of a single sheet of metal. Parts of the limbs 73 of the short circuiting bridge 69 project into the socket receptacle 63 of the electric mating connector 7, where parts of the limbs 73 are respectively plugged into the corresponding short circuiting socket 65. The limbs 73 of the short-circuiting bridge 69 enclose a securing element 77 shown in FIG. 2 which secures the short-circuiting bridge 69 against removal from the receptacle 75 of the contact housing 59. In the plugging position 67 of the electric plug connection 1 through the short circuiting bridge 69, an electric connection is produced between the upper mating short circuiting contact 20 and the lower mating short circuiting contact 20.

A region 79 in FIG. 2 is shown enlarged in FIG. 3. The short circuiting socket 65, as shown in FIG. 3, has a crimp cable shoe 81 and spring contacts 83. The short circuiting bridge 69 rests on a bearing point 74 of the securing element 77. The mating short circuiting contact 20 is electrically and mechanically connected to the short circuiting socket 65 by the crimp cable shoes 81. The spring contacts 83 apply a holding force to the limbs 73 of the short circuiting bridge 69 such that the short circuiting bridge 69 is both held mechanically in the socket receptacle 63 of the electric mating connector 7 and connected in an electrically conductive fashion to the respective mating short circuiting contact 20 by the short circuiting socket 65. A plurality of socket entries 85 have insertion slopes 87 which point counter to the plugging direction S and orient and guide the short circuiting bridge 69.

Figure 4:
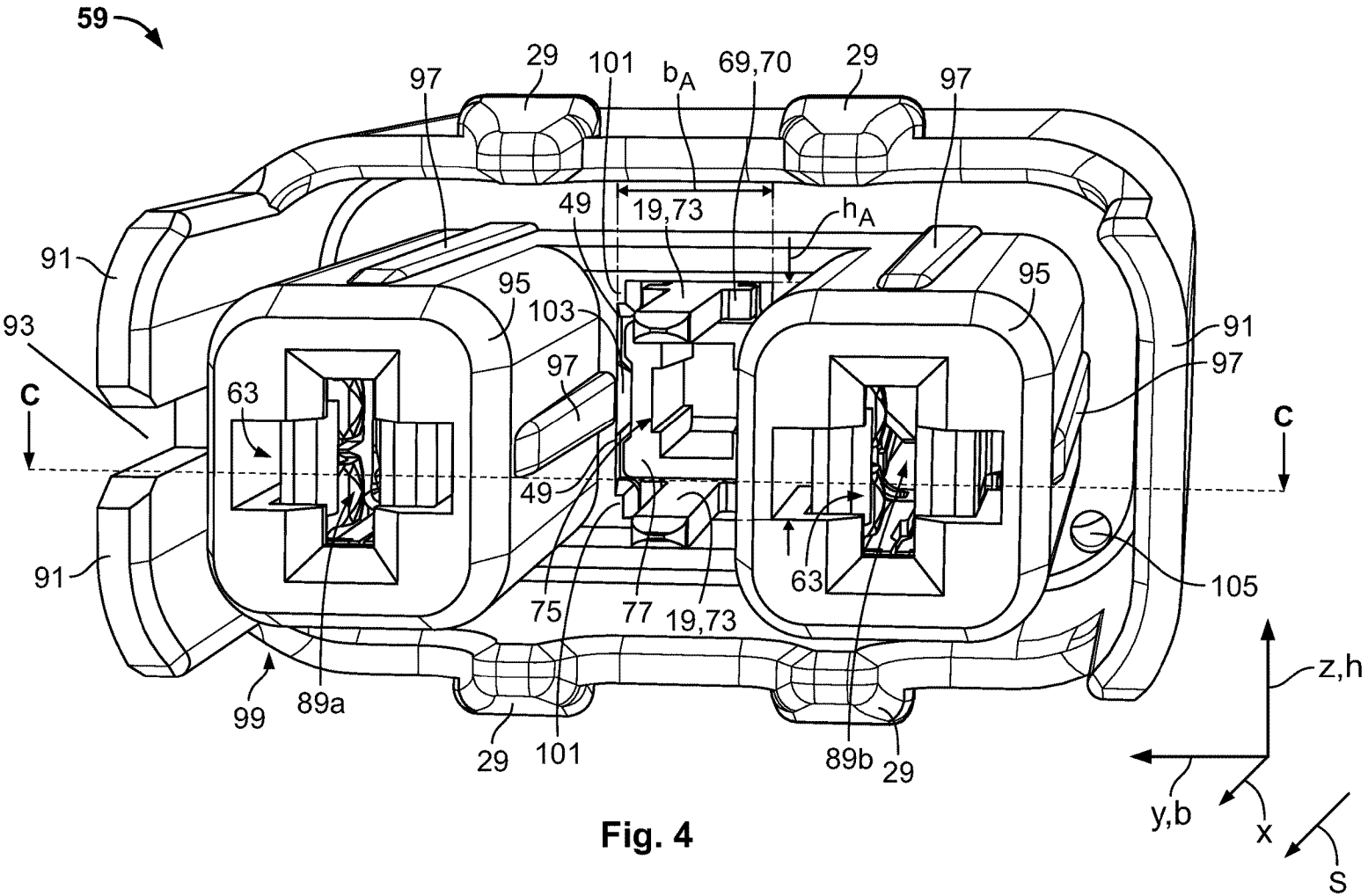
FIG. 4 is a perspective view of a contact housing of the electric plug connection.

The contact housing 59 is shown in FIG. 4. The contact housing 59 has a first loading socket 89*a* and a second loading socket 89*b*. The loading sockets 89*a*, 89*b* accommodate the loading contacts 15 described above. The loading sockets 89*a*, 89*b* are inserted into corresponding socket receptacles 63 of the contact housing 59. The loading contacts 15 are configured in a flat fashion to be able to be inserted into the corresponding loading socket 89*a* or 89*b* in one of two orientations perpendicular with respect to one another.

The prevent the connections of the loading contacts 15 being interchanged or swapped due to rotation of the contact housing 59 by 180° about the x axis, one sidewall 91 of the contact housing 59 has a coding groove 93 into which a correspondingly-shaped element of the first plug housing 25 can be inserted. The contact housing 59 also has a coding bore 105 which, in conjunction with the coding groove 93, prevents faultily oriented plugging together of the plug connector 5 to the electric mating connector 7. In addition to the directional coding by the coding groove 93, additional information on the polarity for the user can be punched or stamped onto the contact housing 59.

The loading sockets 89*a*, 89*b*, as shown in FIG. 3, are accommodated in loading bases 95 which have a square cross section with rounded corners. The loading bases 95 have guiding elevated portions 97 with which the loading bases 95, the contact housing 59 and therefore the entire plug connector 5 can be guided into the complementary receptacle of the mating plug connector 7. The faces of the loading bases 95 which point in the plugging direction S constitute the plug face 99. The receptacle 75 for the securing element 77 is arranged offset into the plug face 99, counter to the plugging direction S.

The receptacle 75 has folds 101 pointing into the interior and latching contours 103 provided in the width direction b as shown in FIG. 4. The receptacle 75 is U shaped and has a width bA which is smaller than a height hA. The limbs 73 of the short circuiting bridge 69 are arranged along the z axis and project from the receptacle 75 in the plugging direction. The limbs 73 do not project beyond the loading bases 95 in the plugging direction S.

The contact housing 59 is configured in and counter to the z direction with latching hooks 29, as shown in FIG. 4, by which the contact housing 59 can be latched into complementary openings in the screening plates 47.

Figure 5:
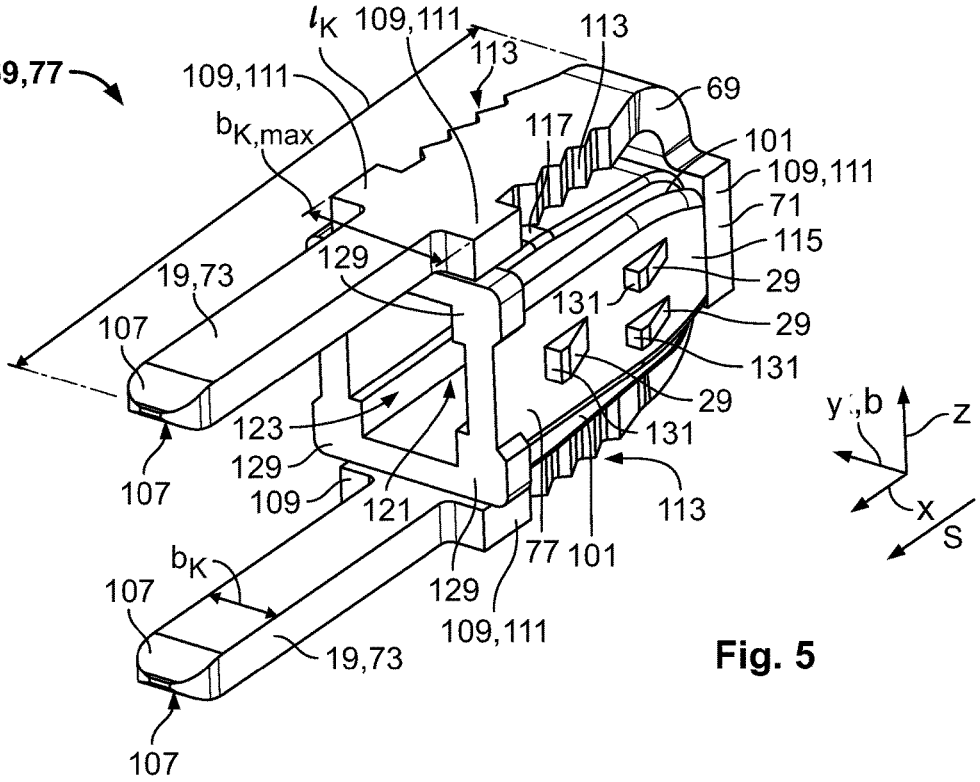
FIG. 5 is a perspective view of a short circuiting bridge and securing element of the contact housing.
Figure 6:
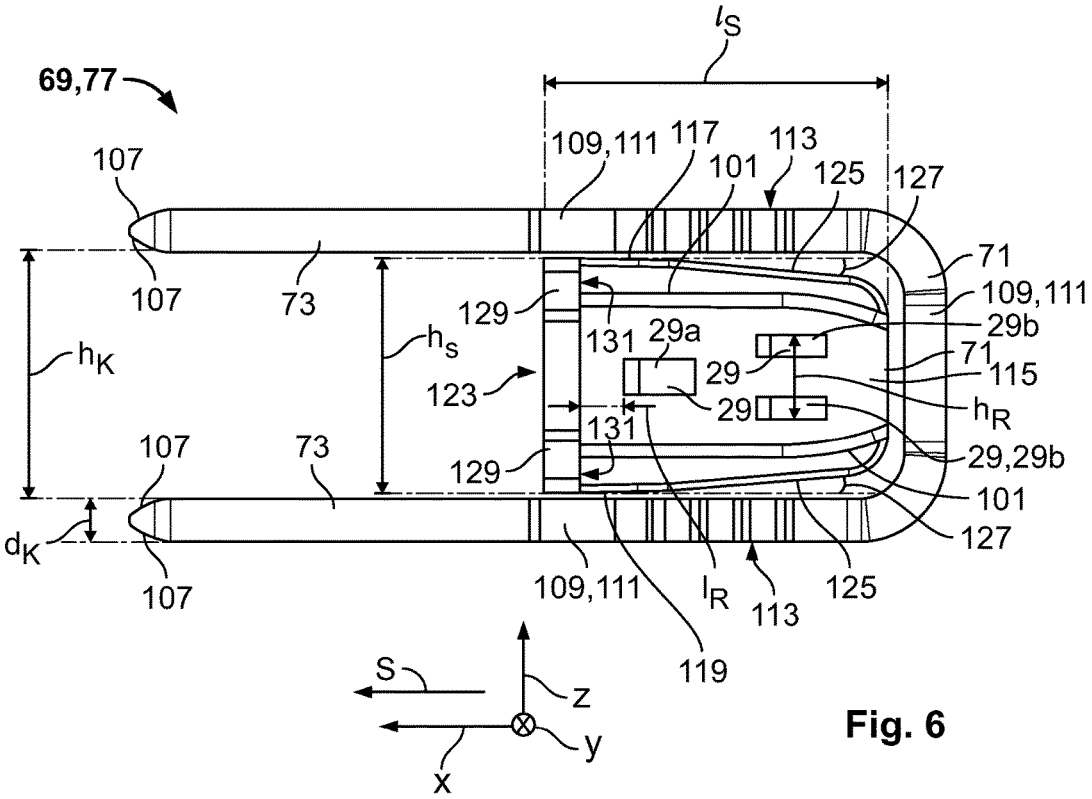
FIG. 6 is a side view of the short circuiting bridge and the securing element.

The short circuiting bridge 69 and the securing element 77 are shown in FIGS. 5 and 6. The position of the short circuiting bridge 69 and the securing element 77 with respect to one another corresponds to a possible position of these elements in the installed state of the electric plug connection 1, i.e. a possible deflection of the short circuiting bridge 69 with respect to the securing element 77 in a plugging position 70 of the short circuiting bridge 69.

The U shaped short circuiting bridge 69 comprises the limbs 73 and the bottom 71 arranged along the z axis as shown in FIGS. 5 and 6. The ends of the limbs 73 pointing in the plugging direction S have bevelled portions 107 which serve to interact with the corresponding insertion slopes 87 during the insertion of the short circuiting bridge 69 into the short circuiting sockets 65. The short circuiting bridge 69 is oriented as it slides along the insertion slopes 87 with the bevelled portions 107 in such a way that the limbs 73 of the short circuiting bridge 69 can be accommodated correctly in the short circuiting sockets 65. The end of the limbs 73 which project in the plugging direction S have a width bK which is equal to or smaller than the width of the complementary short circuiting sockets 65 of the electric mating connector 7. The limbs 73 of the short circuiting bridge 69 are parallel to one another, and the inner sides of the limbs 73 are spaced apart from one another at the distance hK.

The short circuiting bridge 69, as shown in FIGS. 5 and 6, has tilting stops 109. The tilting stops 109 constitute a widening of the short circuiting bridge 69 along the y axis and are configured in such a way that in the insert of the short circuiting bridge 69 they can be employed in other components, for example in plug connectors, as press in shoulders 111. The short circuiting bridge 69 has a tilting stop 109 in the bottom 71 of the short circuiting bridge 69. The two further tilting stops 109 are located approximately in the center of the length 1K of the short circuiting bridge 69 when viewed in the plugging direction S from the bottom 71. The short circuiting bridge 69 shown in FIGS. 5 and 6 is a punched bent part, and the short circuiting bridge 69 has its maximum width bK,max at the tilting stops 109.

Between the tilting stop 109 located on the bottom 71 and the further tilting stops 109, the short circuiting bridge 69 shown in FIGS. 5 and 6 has fluting 113 which corresponds to a saw tooth pattern having three teeth in the shown embodiment. The fluting 113 can serve to attach the short circuiting bridge 69 to another component.

The securing element 77, as shown in FIGS. 5 and 6, has two sidewalls 115, an upper side 117 and an underside 119. The securing element 77 encloses, with its four walls 115, 117, 119, a cavity 121 which has an opening 123 in the plugging direction S and a bottom 71 counter to the plugging direction S. The upper side and the underside 117, 119 of the securing element 77 each have an inclined face 125, with the result that the height hS decreases counter to the plugging direction S, and the securing element 77 consequently tapers in its height hs counter to the plugging direction. The height of the securing element hs is less than the height of the short circuiting bridge hK. The inclined faces 125 are inclined symmetrically in the positive and negative z directions with respect to the plugging direction S and have an angle of inclination 127 with respect to the plugging direction S.

The edges of the securing element 77 which extend in the x direction have folds 101 which point in the direction of the cavity 121. These folds 101 of the securing element 77 are each complementary to the corresponding fold 101 of the contact housing 59.

The boundary of the opening 123 pointing in the plugging direction S comprises flange sections 129 which each comprise a stop face 131 pointing counter to the plugging direction S. Latching hooks 29 are provided on the sidewalls 115 of the securing element 77, wherein the stop faces 131, running perpendicularly with respect to the plugging direction S, of all the latching hooks 29 point in the plugging direction S. In each case, a latching hook **29*a* is located closer to the flange sections 129 of the corresponding sidewall 115 in the plugging direction S and centrally between the two flange sections 129 in the z direction. The stop faces 131, pointing counter to the plugging direction S, of the flange sections 129 and the stop faces 131, pointing in the plugging direction S, of the latching hook 29*a* are spaced apart from one another by a length 1R. The latching hooks 29*b* which are located closer to the bottom 71 of the securing element 77** have a maximum distance hR from one another.

As shown in FIGS. 5 and 6, the securing element 77 is located completely between the limbs 73 of the short circuiting bridge 69 in the plugging direction S, but the securing element 77 projects on both sides in the y direction over its entire length 1S beyond the short circuiting bridge.

Figure 7:
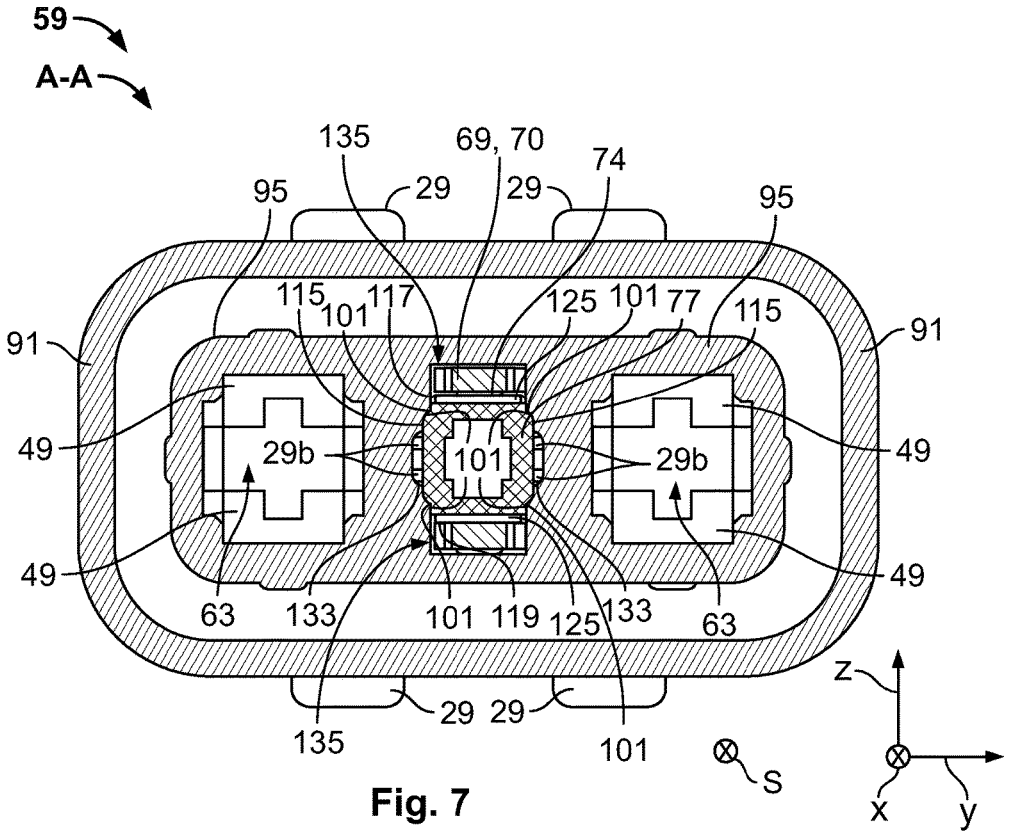
FIG. 7 is a sectional view of the contact housing taken along line A-A of FIG. 2.
Figure 8:
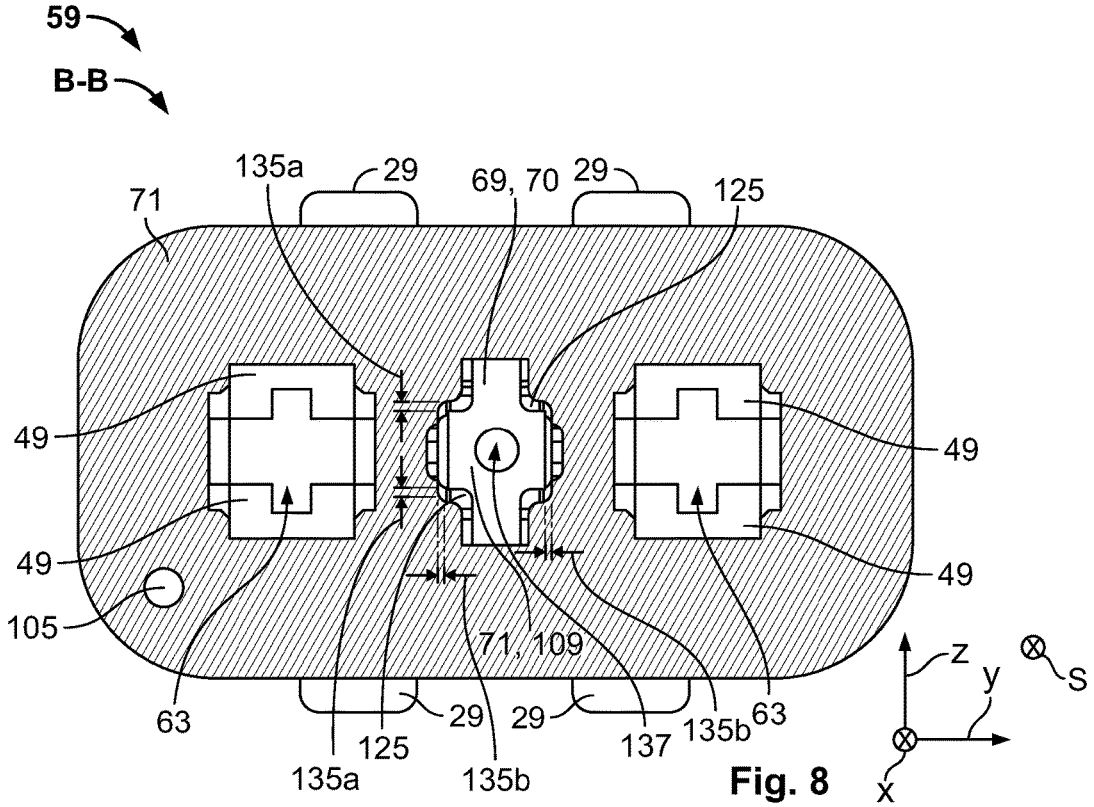
FIG. 8 is a sectional view of the contact housing taken along line B-B of FIG. 2.

The contact housing 59 is shown in FIGS. 7-9. The securing element 77 is shown with a section in a region in which the securing element 77 has already tapered, with the result that the inclined faces 125 can be seen in FIG. 7. The short circuiting bridge 69 rests on the securing element 77 at the bearing point 74. The folds 101 which point in the direction of the cavity 121 of the securing element 77 are supported in a complementary fashion on the corresponding folds 101 of the contact housing 59. This support is provided on all four edges of the securing element 77, with the result that said securing element 77 is securely accommodated in the receptacle 75.

The latching hooks **29*b* of the securing element 7, as shown in FIG. 7, are accommodated in a guide groove 133 of the receptacle 75 in such a way that tilting of the securing element 77 about the y axis is prevented. Said guiding by the latching hooks 29*b* in the guide groove 133 takes place on both sides on the sidewalls 115 of the securing element 77. A gap 135 is formed between the securing element 77 secured in the receptacle 75 and the short circuiting bridge 69**.

The section of the contact housing 59 in FIG. 8 shows a region in which the loading bases 95 merge monolithically with the bottom 71 of the contact housing and with the sidewalls 91. The coding bore 105, the latching hooks 29 and the retaining contours 49, on which loading sockets (not shown), inserted in the plugging direction into the socket receptacles 63, are supported, are also shown. The inclined faces 125 of the securing element 77 have moved towards one another to such an extent that they are partially concealed, in particular in the z direction, by the tilting stop 109.

The short circuiting bridge 69 has the gap 135*a* along the z-axis both in z direction and counter to the z direction. The short circuiting bridge 69 also has the gap 135*b* in the y direction both along the y axis and counter to the y axis between the short circuiting bridge 69 and the contact housing 59. Depending on the relative position of the short circuiting bridge 69 with respect to the contact housing 59 it is possible for the short circuiting bridge 69 to be supported on the contact housing 59 in such a way that the gap 135 is not symmetrical about the tilting stop 109 of the short-circuiting bridge 69 but instead respectively extends only in or counter to a spatial direction. In an embodiment, the gap 135*a* is several 1/10 mm to approximately 8/10 mm in the z direction. In another embodiment, the gap 135*a* in the z direction is approximately 5/10 mm.

A bore 137 is shown in the bottom 71 of the short circuiting bridge 69 in FIG. 8. In an embodiment of the electric plug connection, the bore 137 can accommodate a further tilting stop 109 which extends from the bottom of the receptacle 75 of the securing element 77 in the plugging direction S and can be configured in the form of a pin. In another embodiment, the bore 137 of the short circuiting bridge 69 can serve to attach the short circuiting bridge 69 by a suitable attachment, for example a screw or a bolt.

In the section of the contact housing 59 shown in FIG. 9, the short circuiting bridge 69 is arranged offset counter to the plugging direction S with respect to loading sockets which are inserted in the socket receptacles 63. The stop faces 131 of the latching hooks 29*a* are supported on the latching contours 103 of the contact housing 59 and the latching hooks 29*a*, 29*b* of the securing element 77 are supported in and counter to the y direction in the receptacle 75 on the contact housing 59. The securing element 77 is therefore secured in the receptacle 75, as described above. The concealed flange sections of the securing element 77 are supported on a retaining contour 49; two of the four retaining contours 49 of the receptacle 75 are shown in FIG. 4. FIG. 9 also shows the coding groove 93 and the latching openings 31 for accommodating the latching hooks of the screening plates.

During the plugging together, the formation of contact of the short circuiting bridge 69 with the mating short circuiting contacts 20 can take place only after the contact closure of the loading contacts 15, with the result that currents or voltages cannot be applied to the loading lines of the conductor 37 until the formation of contact of the short circuiting bridge 69 with the mating short circuiting contacts 20 signals that the plug connector 5 has been plugged into the mating connector 7.

In the plugged together state, the short circuiting bridge 69 can no longer move relative to the mating connector 7, but a relative movement of the short circuiting bridge 69 with respect to the plug connector 5 is possible due to the gap 135; the short circuiting bridge 69 is movable about the plugging position 77 of the short circuiting bridge 69 in the receptacle 75. The gap 135 permits the short circuiting bridge 69 to make a movement about its plugging position 70 in all three spatial directions and tilting about the three spatial axes.

In an embodiment, the short circuiting bridge 69 can be accommodated so as to be movable about the plugging position 70 in the gap 135 by not more than five material thicknesses of the short circuiting bridge 69. In another embodiment, the short circuiting bridge 69 can be accommodated so as to be movable by not more than two material thicknesses of the short circuiting bridge 69. In various embodiments, the play of the short circuiting bridge 69 in or counter to the plugging direction S can be approximately 0.5 to 3.0 mm, and in a further embodiment, is 1 mm.

A maximum tilting of the short circuiting bridge 69 can be reached, for example, when the inclination of the short circuiting bridge 69 corresponds to the inclination of the inclined faces 125 of the securing element 77 and the short circuiting bridge 69 rests on said face. In an embodiment, the short circuiting bridge 69 can tilt by approximately +/2.5° to approximately +/15°, or approximately +/5°, with respect to the plugging direction S.

The short circuiting contacts 19 of the short circuiting bridge 69 are thus mechanically decoupled from a movement of the plug connector 5 due to the movement of the short circuiting bridge 69 in the gap 135 about the plugging position 70. Vibrations of the plug connector 5 can therefore be decoupled mechanically from the short circuiting bridge 69.

The gap 135 dimensioned in such a way that when the plug connection 1 between the plug connector 5 and the mating connector 7 is disconnected, the short circuiting bridge 69 is disconnected from the short circuiting contacts 20 before electric load contacts are disconnected from one another.

What is claimed is:

1. A plug connector for connection with a mating connector in a plugging direction, comprising:

a plug housing having a receptacle; and a short circuiting bridge held in a plugging position in the receptacle and having a pair of short circuiting contacts accessible from outside the plug connector counter to the plugging direction, the short circuiting bridge capable of tilting within the receptacle having at least one tilting stop and movable about the plugging position within the receptacle.

2. The plug connector of claim 1, wherein the short circuiting bridge is movable within the receptacle in a transverse direction with respect to the plugging direction.

3. The plug connector of claim 1, wherein the short circuiting bridge is movable within the receptacle in a direction along or counter to the plugging direction.

4. The plug connector of claim 1, wherein the receptacle is U-shaped.

5. The plug connector of claim 4, wherein the short circuiting bridge is U-shaped.

6. The plug connector of claim 5, wherein the short circuiting bridge is movable within the receptacle in a direction transverse with respect to the plugging direction and/or is movable within the receptacle in a direction along or counter to the plugging direction relative to a bottom of the receptacle.

7. The plug connector of claim 1, further comprising a securing element capable of being plugged into the receptacle and securing the short circuiting bridge in the receptacle.

8. The plug connector of claim 7, wherein the securing element is disposed between the short circuiting contacts of the short circuiting bridge.

9. The plug connector of claim 8, wherein the securing element has at least one bearing point about which the short circuiting bridge can tilt.

10. The plug connector of claim 7, wherein the securing element has a latching hook engageable with a latching contour of the receptacle to latch the securing element in the receptacle.

11. The plug connector of claim 7, wherein the securing element has a height measured in a direction perpendicular to the plugging direction which decreases in a direction counter to the plugging direction.

12. The plug connector of claim 1, wherein the short circuiting bridge can tilt by approximately +/2.5° to approximately +/15° with respect to the plugging direction within the receptacle.

13. The plug connector of claim 1, wherein the short circuiting bridge can tilt by approximately +/5° with respect to the plugging direction within the receptacle.

14. An electric plug connection, comprising:

a plug connector having a plug housing with a receptacle and a short circuiting bridge held in a plugging position in the receptacle, the short circuiting bridge having a pair of short circuiting contacts accessible from outside the plug connector counter to the plugging direction, the short circuiting bridge capable of tilting within the receptacle having at least one tilting stop and movable about the plugging position within the receptacle; and a mating connector having a plurality of mating short circuiting contacts, the short circuiting contacts of the short circuiting bridge are electrically connected to the mating short circuiting contacts in the plugging position and are mechanically decoupled from a movement of the plug connector.

* * * * *